US006360370B1

(12) United States Patent
Ferreras

(10) Patent No.: US 6,360,370 B1
(45) Date of Patent: Mar. 26, 2002

(54) FOUL-WEATHER CLOTHING SYSTEM

(76) Inventor: Jerome C. Ferreras, P.O. Box 161163, Altamonte Springs, FL (US) 32716

( * ) Notice: Subject to any disclaimer, the term of this patent is extended or adjusted under 35 U.S.C. 154(b) by 0 days.

(21) Appl. No.: 09/819,240

(22) Filed: Mar. 28, 2001

(51) Int. Cl.[7] ..... A41D 3/08
(52) U.S. Cl. ..... 2/84; 2/69
(58) Field of Search ..... 2/69, 79, 86, 227, 2/88, 50, 51, 94, 89, 48, 85, 108, 93, 207, 242, 46, 914, 114, 69.5, 468, 98, 208; 36/2 R

(56) References Cited

U.S. PATENT DOCUMENTS

| | | | |
|---|---|---|---|
| 2,911,649 | A | 11/1959 | Ruelle et al. |
| 3,389,407 | A | 6/1968 | Morrison |
| 3,801,986 | A | 4/1974 | Purdon |
| 4,030,646 | A | 6/1977 | Switack et al. |
| 4,426,740 | A | 1/1984 | Reverberi |
| 4,718,122 | A | 1/1988 | Steverson |
| 4,944,041 | A | 7/1990 | Buenos et al. |
| 5,996,121 | A | 12/1999 | Harris |
| 6,003,749 | A | 12/1999 | Sabo |

*Primary Examiner*—John J. Calvert
*Assistant Examiner*—Tejash Patel
(74) *Attorney, Agent, or Firm*—Edward M. Livingston, Esq.

(57) ABSTRACT

A foul-weather clothing system has one or more wraparound pouches (1, 2, 3, 7, 9, 11, 13) into which foul-weather wraparound clothing (4, 5, 6, 8, 10, 12) is compacted in position to be released down to wrap circumferentially about predetermined portions of a person. Fasteners (14, 15) are provided as needed for predetermined wraparound positioning of the wraparound clothing on the person and for positioning the wraparound clothing in the wraparound pouches when not released. Waist, trouser, skirt, full-length and shawl embodiments are provided for separate use conditions and user preferences.

38 Claims, 7 Drawing Sheets

FIG. 1
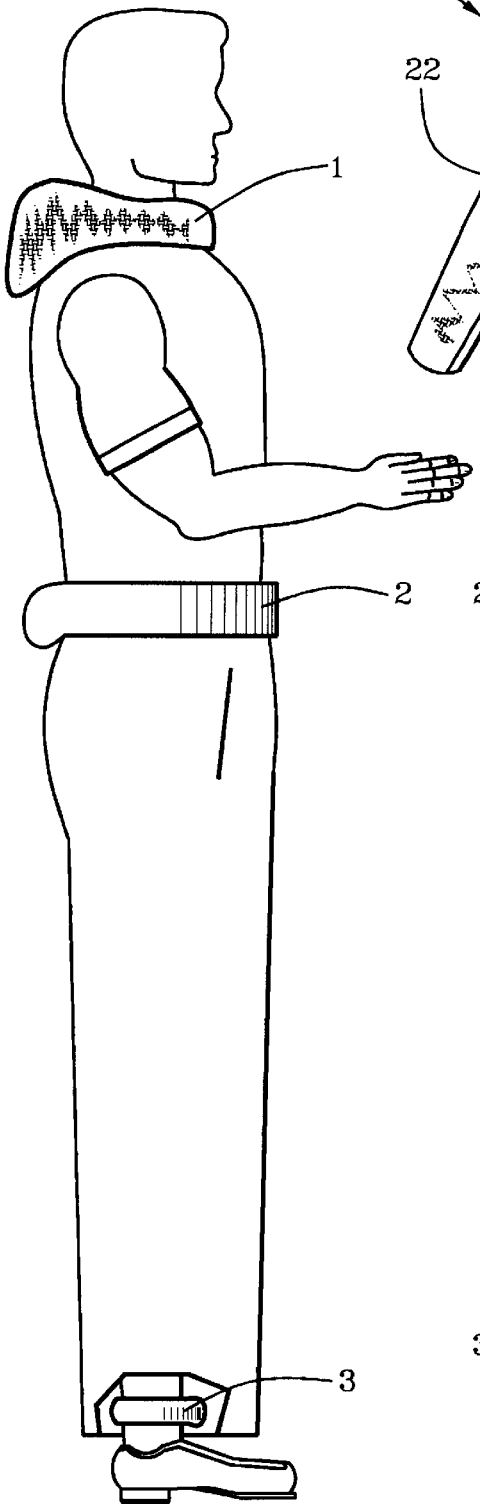
FIG. 2
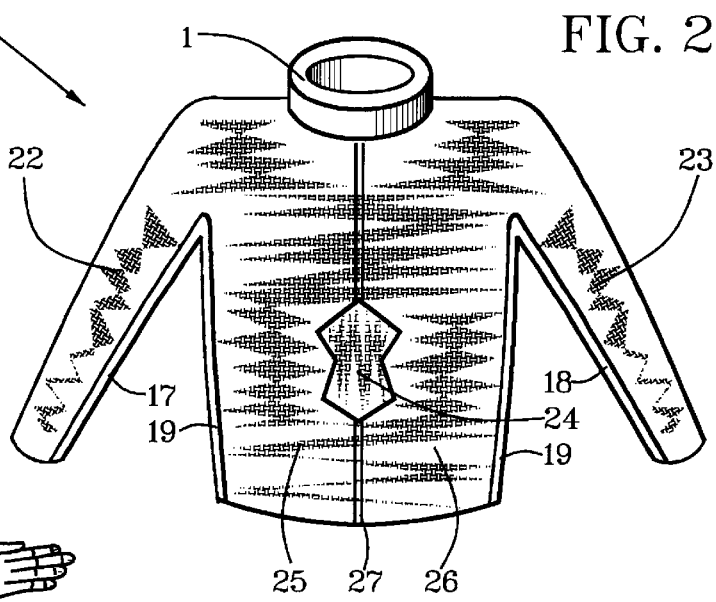
FIG. 3
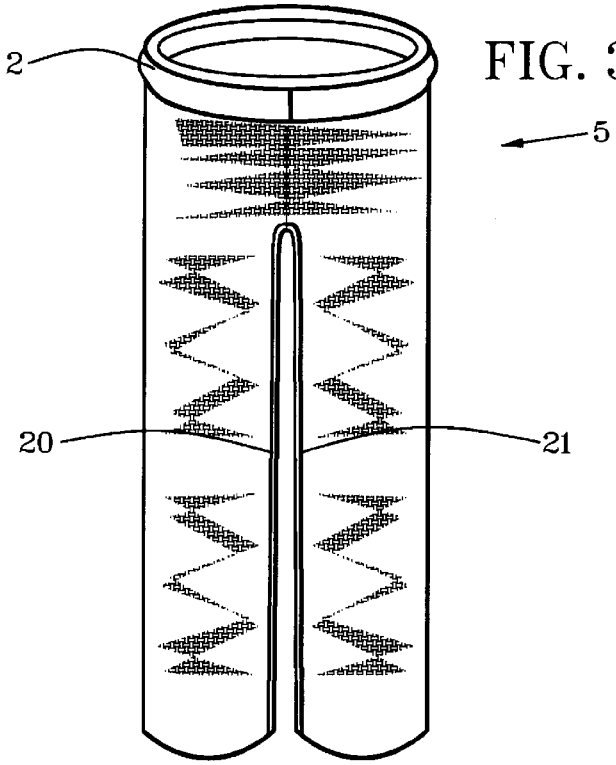
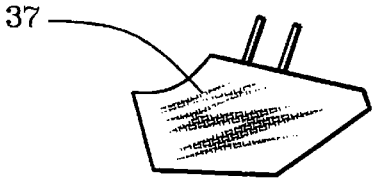
FIG. 4

FOUL-WEATHER CLOTHING SYSTEM

BACKGROUND OF THE INVENTION

This invention relates to foul-weather clothing that is compacted into foul-weather-clothing pouches that can be strap-carried or wrapped around a person for being released to cover them in the event of foul weather.

Numerous foul-weather-clothing systems and devices are known. None are known, however to have the convenience of carrying and releasing of foul-weather clothing for fully covering a person in a manner taught by this invention.

Examples of most-closely related known but different foul-weather-protection devices are described in the following patent documents:

| U.S. Pat. No. (U.S. unless stated otherwise) | Inventor | Issue Date |
|---|---|---|
| 2,911,649 | Ruelle, et al. | 11/10/1959 |
| 4,426,740 | Reverberi | 01/24/1984 |
| 3,389,407 | Morrison | 06/25/1968 |
| 4,944,041 | Buenos, et al. | 07/31/1990 |
| 3,801,986 | Purdon | 04/09/1974 |
| 5,996,121 | Harris | 12/07/1999 |
| 4,030,646 | Switack, et al. | 06/21/1977 |
| 6,003,749 | Sabo | 12/21/1999 |
| 4,718,122 | Steverson | 01/12/1988 |

SUMMARY OF THE INVENTION

Objects of patentable novelty and utility taught by this invention are to provide a foul-weather clothing system which:

- can be worn compacted as fair-weather clothing on a person during good weather and then released quickly and conveniently as foul-weather clothing when needed;
- can be hand carried by or strapped to the person during good weather and then released quickly and conveniently as foul-weather clothing when needed;
- covers select portions or all of the body as desired; and
- can be re-compacted quickly and conveniently after use when not needed.

This invention accomplishes these and other objectives with a foul-weather clothing system having one or more wraparound pouches into which foul-weather wrap clothing is compacted in position to be released down to wrap circumferentially about predetermined portions of a person. Fasteners are provided as needed for predetermined wraparound positioning on the person's torso, arms, legs and feet.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

FIG. 1 is a side elevation view of the foul-weather clothing system in a stowed mode in a neck pouch, a waist pouch and a leg pouch on a person;

FIG. 2 is a front view of a waist wraparound in a use mode;

FIG. 3 is a front view of a trouser wraparound in a use mode;

FIG. 4 is a top view of a shoe cover that is opened to be positioned on a shoe;

DESCRIPTION OF PREFERRED EMBODIMENT

Figure 5:
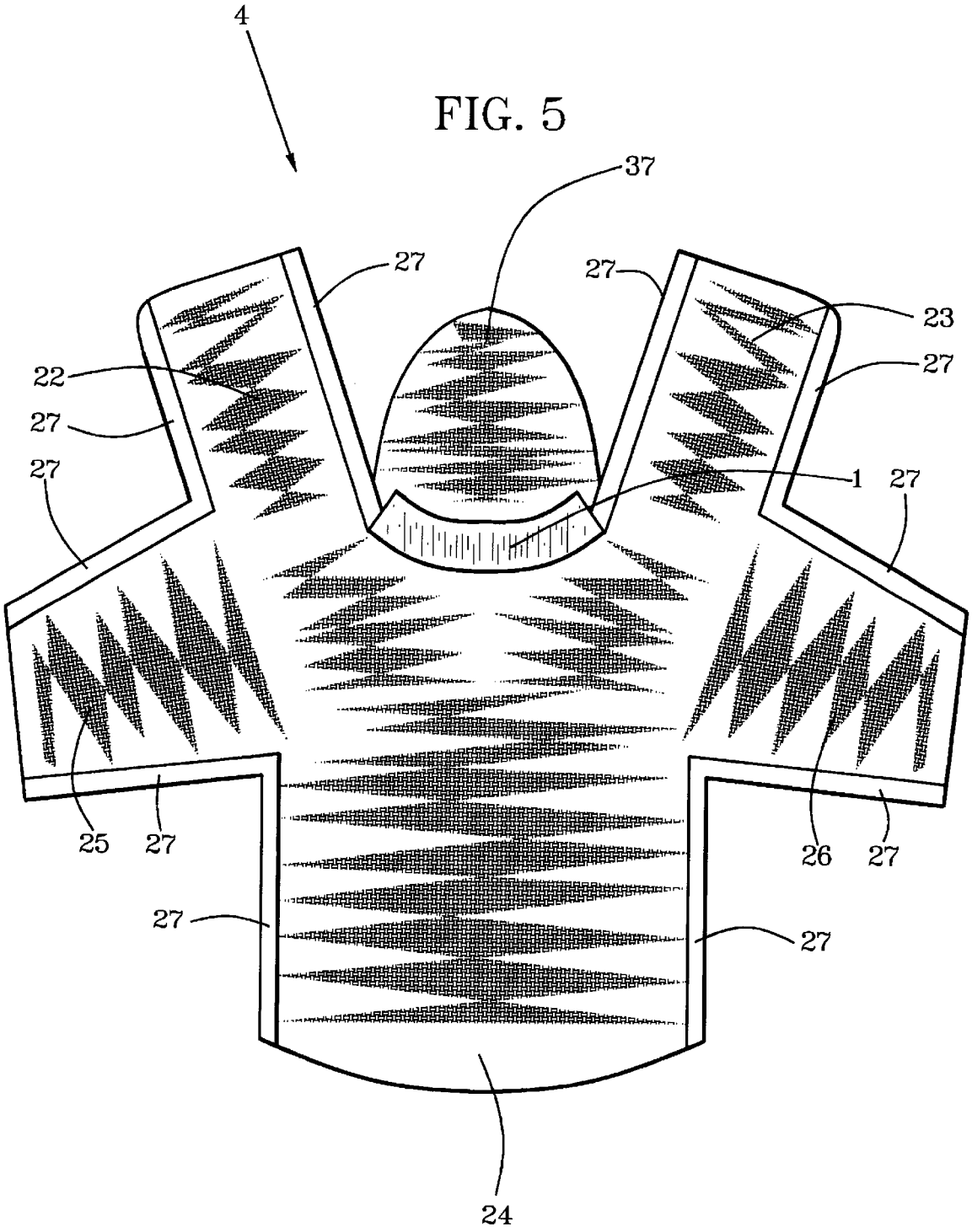
FIG. 5 is an inside-front view of the waist wraparound opened to be positioned on the person.

Listed numerically below with reference to the drawings are terms used to describe features of this invention. These terms and numbers assigned to them designate the same features throughout this description.

| | |
|---|---|
| 1. | Top pouch |
| 2. | Bottom pouch |

-continued

| | |
|---|---|
| 3. | Leg pouch |
| 4. | Waist wraparound |
| 5. | Trouser wraparound |
| 6. | Pullover wraparound |
| 7. | Pullover top pouch |
| 8. | Skirt wraparound |
| 9. | Skirt bottom pouch |
| 10. | Shawl wraparound |
| 11. | Shawl top pouch |
| 12. | Full-length wraparound |
| 13. | Full-length top pouch |
| 14. | Velcro ® |
| 15. | Zipper |
| 16. | Pouch openings |
| 17. | Right-arm fastener |
| 18. | Left-arm fastener |
| 19. | Waist fastener |
| 20. | Right-leg fastener |
| 21. | Left-leg fastener |
| 22. | Right-arm wraparound |
| 23. | Left-arm wraparound |
| 24. | Waist-aft section |
| 25. | Front-right section |
| 26. | Front-left section |
| 27. | Opening fasteners |
| 28. | Trouser legs |
| 29. | Trouser crouch |
| 30. | Tie lines |
| 31. | Right armpit |
| 32. | Left armpit |
| 33. | Right wrist band |
| 34. | Left wrist band |
| 35. | Double-fastener wraparound |
| 36. | Wraparound openings |
| 37. | Shoe cover |
| 38. | Closure orifice |
| 39. | Pouch fastener |
| 40. | Front fastener |
| 41. | Pouch-tote bag |
| 42. | Shoulder strap |
| 43. | Hand strap |

Referring first to FIGS. 1–3, 7–9, and 11–17, for foul-weather protection, a wraparound pouch, which can include a top pouch 1, a bottom pouch 2 and a leg pouch 3, is wrapped around a pouch-wrap portion of a person, which can include the person's neck, waist and legs respectively. Wraparound clothing, preferably attached to the pouches, is compacted by being wound, stuffed or folded into appropriate pouches for a stowage mode when not being used and when carried on the person. The wraparound clothing can include a waist wraparound 4 shown in FIGS. 2 and 5 for the top pouch 1, a trouser wraparound 5 shown in FIGS. 3 and 6 for the bottom pouch 2, a pullover wraparound 6 shown in FIG. 7 for a pullover top pouch 7, a skirt wraparound 8 shown in FIG. 8 for a skirt bottom pouch 9, a shawl wraparound 10 shown in FIG. 9 for a shawl top pouch 11, and a full-length wraparound 12 shown in FIGS. 11–12 for a full-length top pouch 13.

Figure 20:
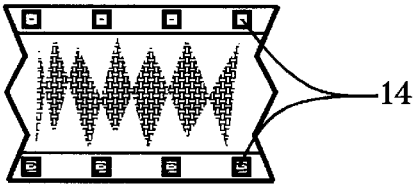
FIG. 20 is a cutaway portion of wraparound clothing having a plurality of hook-and-loop fasteners.
Figure 21:
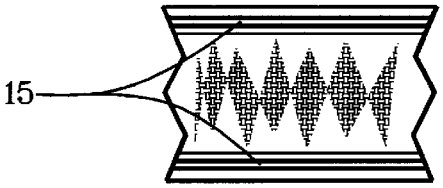
FIG. 21 is a cutaway portion of wraparound clothing having a zipper fasteners.

At least one fastener, which can include Velcro® 14 shown in FIG. 20 and a zipper 15 shown in FIG. 21 for pouch fastening and for clothing fastening, is articulated and positioned to prevent release of wraparound clothing from wraparound pouches for a stowage mode and to release the wraparound clothing from the wraparound pouches for a use mode. The wraparound clothing is articulated to wrap around a predetermined portion of the person when the wraparound clothing is released from the wraparound pouches. Pouch openings 16 are provided in bottoms of the wraparound pouches 1–3, 7, 9, 11 and 13 as represented by dashed lines in FIGS. 13–16.

The wraparound clothing can be made of waterproof material, light-weight waterproof material, waterproof material that is temperature-difference resistant or material that is sunlight resistant. The light-weight waterproof material is preferable for most purposes.

An embodiment of the waist wraparound 4 shown in FIG. 2 includes a right-arm fastener 17 to wraparound-fasten the wraparound clothing to the person's right arm, a left-arm fastener 18 to wraparound-fasten the wraparound clothing to the person's left arm and a waist fastener 19 to wraparound fasten the wraparound clothing to the person's waist.

An embodiment of the trouser wraparound 5 shown in FIG. 3 includes a right-leg fastener 20 to wraparound-fasten the wraparound clothing to the person's right leg and a left-leg fastener 21 to wraparound-fasten the wraparound clothing to the person's left leg.

The fasteners 17–21 can include the Velcro® 14 and the zipper 15 in addition to other select fasteners.

A preferred embodiment of the waist wraparound 4 shown in a use mode in FIG. 2 and unfolded in FIG. 5 includes a right-side opening intermediate the waist wraparound 4 and a right-arm wraparound 22. The right-arm wraparound 22 includes a right-arm opening intermediate the right-arm wraparound and the right-side opening. The waist wraparound 4 includes a left-side opening intermediate the waist wraparound 4 and a left-arm wraparound 23. The left-arm wraparound 23 includes a left-arm opening intermediate the left-arm wraparound 23 and the left-side opening.

The waist wraparound 4 shown in FIG. 5 includes a waist-aft section 24 and a waist-front section intermediate the right-side opening and the left-side opening. The waist-front section includes a front-right section 25 and a front-left section 26 having an opening fastener 27 intermediate the front-right section 25 and the front-left section 26.The right-side opening, the right-arm opening, the left-side opening, the left-arm opening and the front-section opening include opening fasteners 27 with which to fasten close the right-arm wraparound 22, the left-arm wraparound 23 and the waist-front section.

The opening fasteners can include the Velcro® 14, the zipper 15 and other select clothing fasteners.

Figure 6:
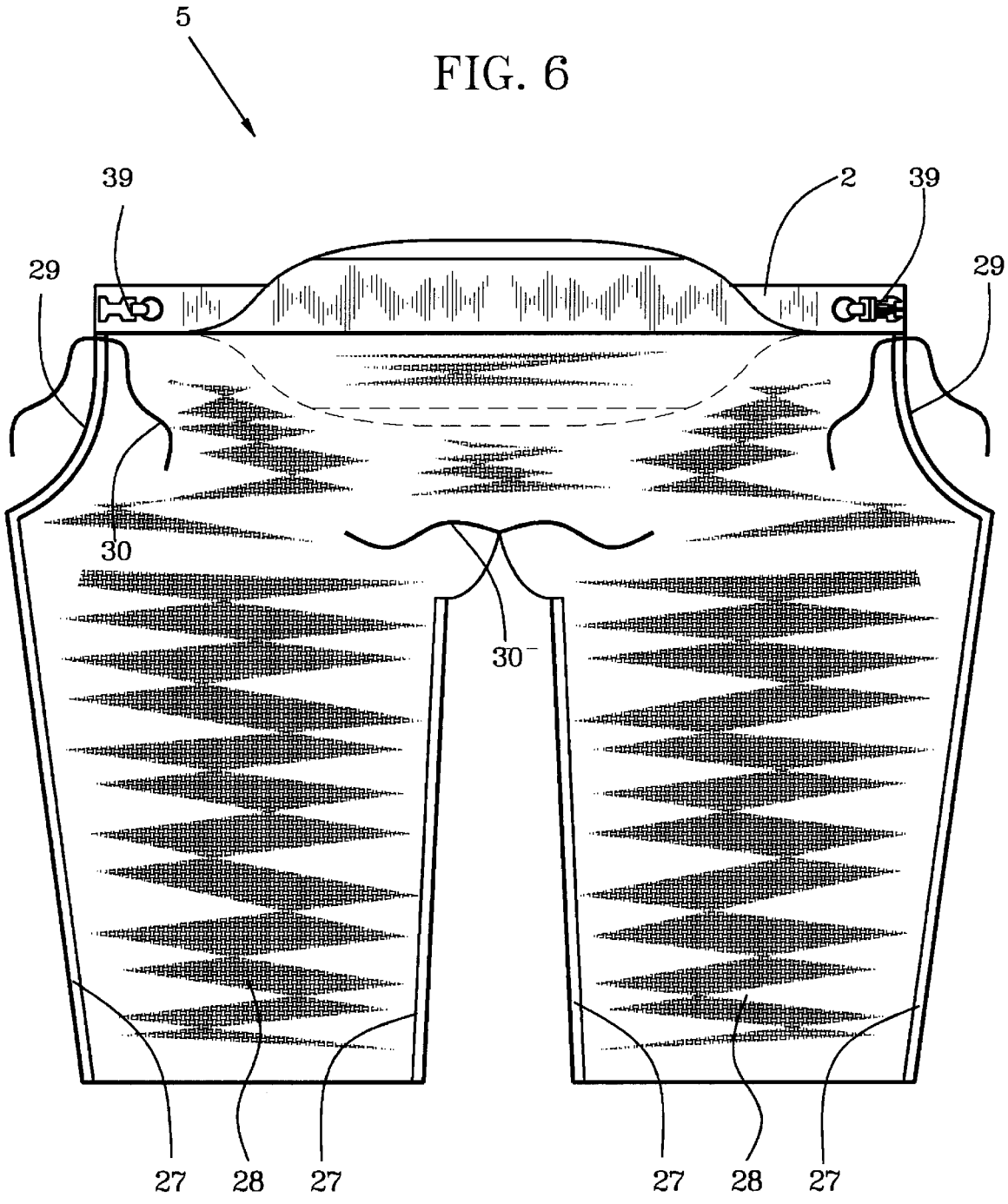
FIG. 6 is an inside-front view of the trouser-wraparound clothing opened to be positioned on the person.

A preferred embodiment of the trouser wraparound 5 shown in FIG. 6 has trouser legs 28 with linearly open edges that are fastened with the opening fasteners 27 intermediate trouser-leg bottoms and a trouser crouch 29. Tie lines 30 can be provided for reinforcement fastening and for initial fastener holding. Also shown is the bottom pouch 2 in a pulled-open condition to illustrate containment capacity of the bottom pouch 2 and other pouches 1, 3, 7, 9, 11 and 13.

Figure 7:
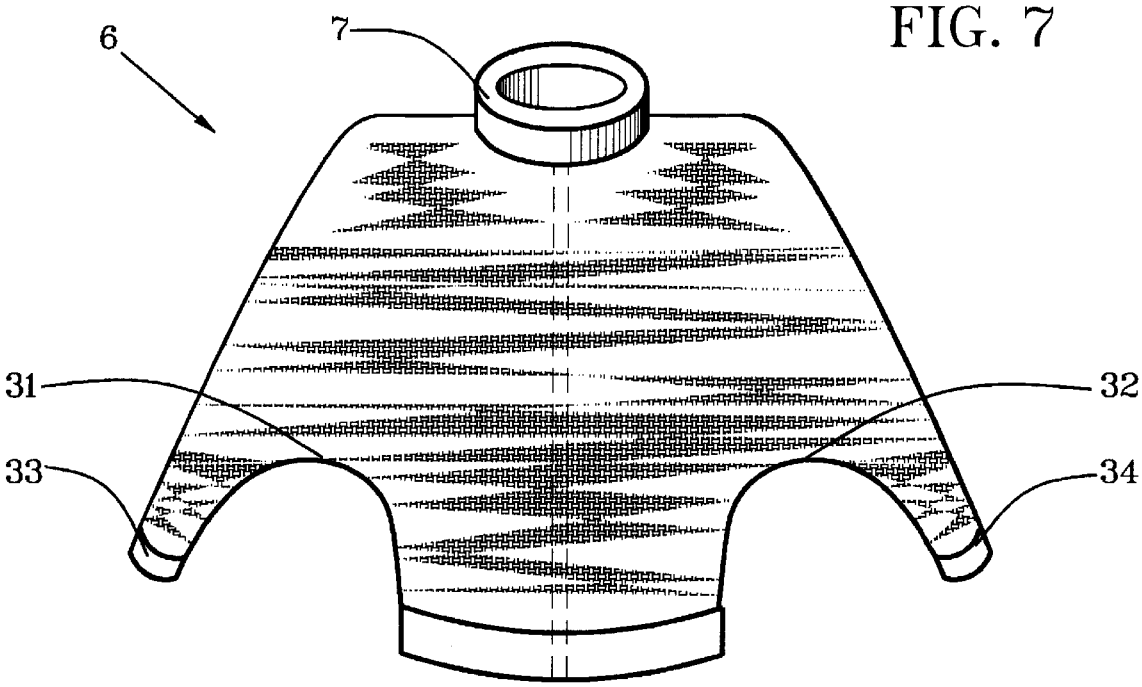
FIG. 7 is a front view of an optional fastenerless waist wraparound in a use mode.
Figure 8:
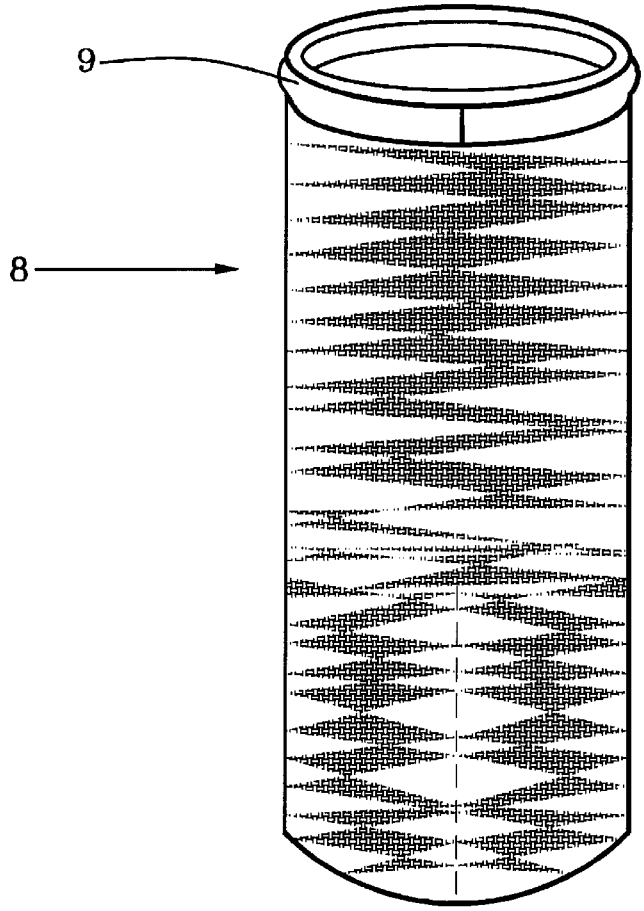
FIG. 8 is a front view of an optional fastenerless hip wraparound in a use mode.

The pullover wraparound 6 shown in FIG. 7 is an embodiment that is easy to use but more restrictive of arm movement for some users such as ladies in optional combination with the skirt wraparound 8 shown in FIG. 8. The pullover wraparound 6 preferably has a right armpit 31 and a left armpit 32 that are low for arm pass-through to and from a right wrist band 33 and a left wrist band 34. Optionally, the right armpit 31 and the left armpit 32 can be open with right-arm openings, right-side openings, left-arm openings and left-side openings for arm pass-through to and from the right wrist band 33 and the left wrist band 34. The skirt wraparound 8 can include a skirt expander to expand the skirt bottom circumferentially for accommodating leg movements.

Figure 9:
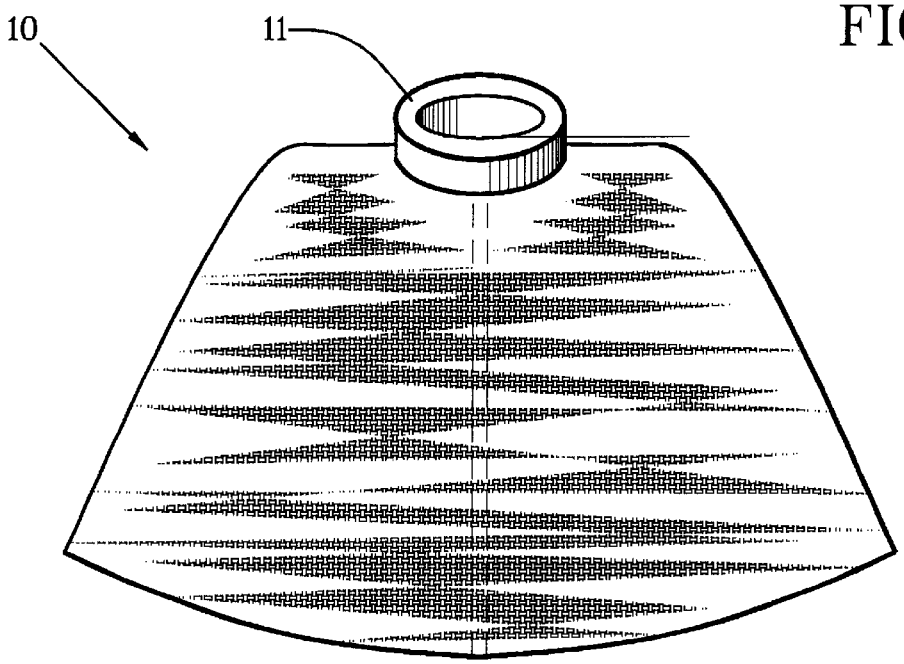
FIG. 9 is a front view of an optional fastenerless shoulder wraparound in a use mode.

The shawl wraparound 10 shown in FIG. 9 is an embodiment that also is easy to use but has less length coverage. It also could be used in combination with the skirt wraparound 8 shown in FIG. 8 for ladies and people not needing extensive leg movement.

Figure 10:
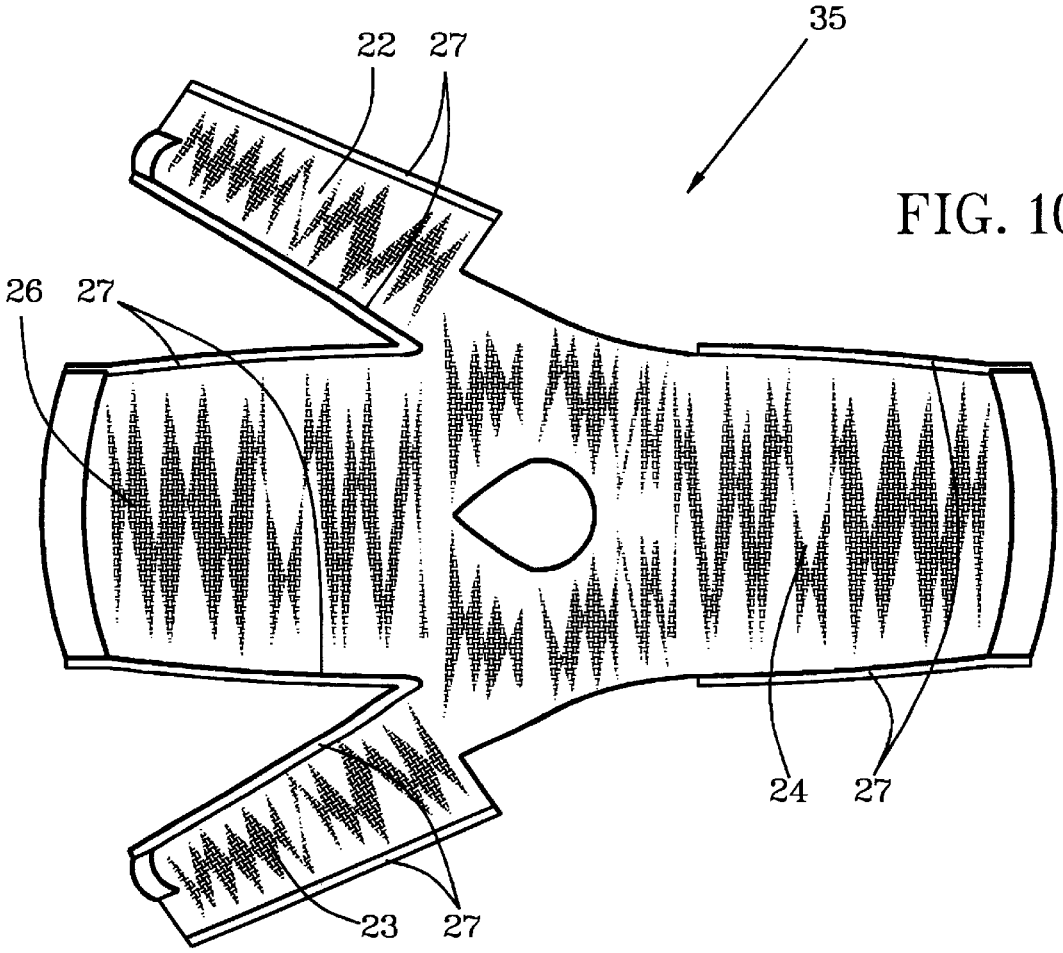
FIG. 10 is a top view of an optional double-fastener waist wraparound in an unfastened mode.

A double-fastener wraparound 35 shown in FIG. 10 is a least preferred embodiment due to multiple fastening to use it. For simplicity and use convenience of other embodiments of this invention, it is illustrated next to the shawl wraparound 10.

Figure 11:
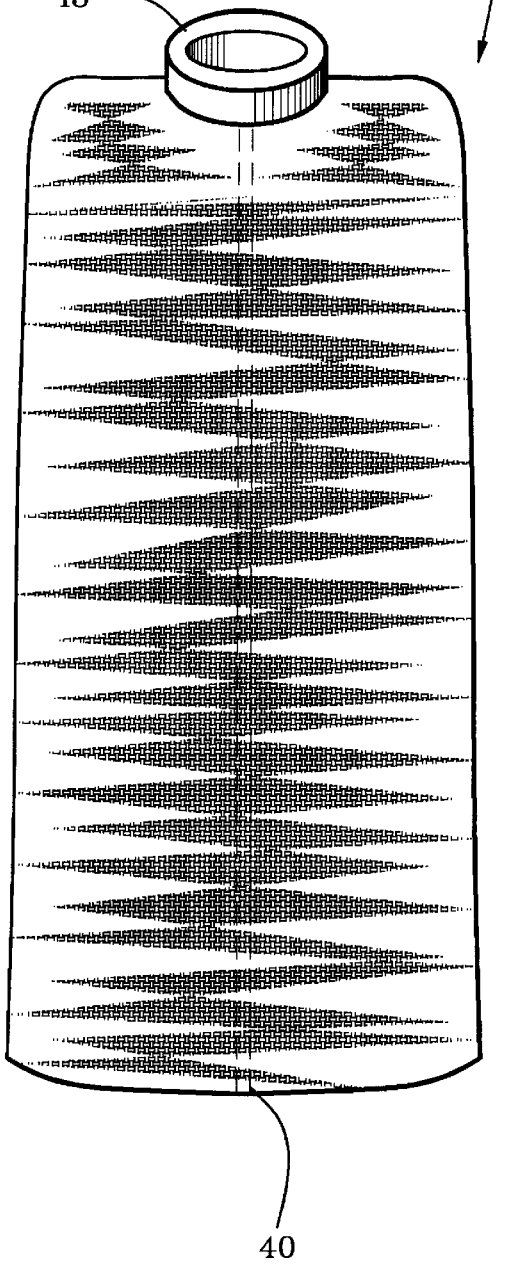
FIG. 11 is a front view of an optional full-length wraparound in a use mode.
Figure 12:
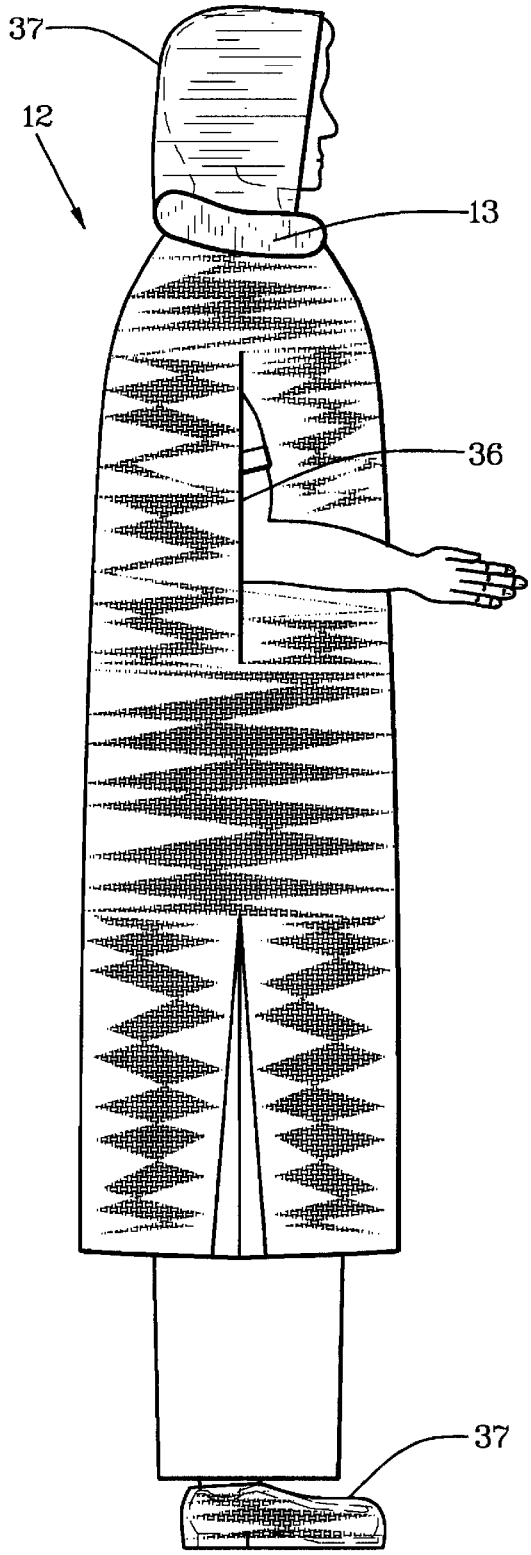
FIG. 12 is a side view of the FIG. 11 full-length wraparound in a use mode on a person in combination with a shoe cover and a neck-pouch hood.

The full-length wraparound 12 shown in FIGS. 11–12 is an embodiment that is easy to use and also has full-length coverage. It has wraparound openings 36 that are oppositely disposed for arm and hand outlets and can be extended predeterminedly long down and around the person's waist, hips and legs.

As shown in FIGS. 5 and 10, a hood 37 can be extended from the top pouch 1 for head coverage.

Figure 17:
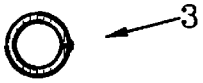
FIG. 17 is a top view of a leg pouch that is sized, shaped and articulated to contain the leg wraparound in a stowage mode.

Worn around both legs separately proximate the person's ankles, leg pouches 3 shown in FIGS. 1 and 17 can contain a shoe cover 37 shown in FIGS. 4 and 12 that covers footwear predeterminedly when released from a stowage mode. The shoe cover 37 can be made to cover tops and bottoms or only tops of shoes.

Figure 13:
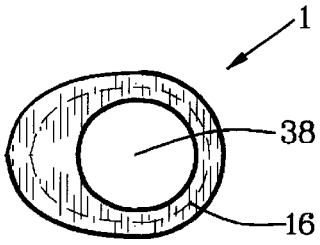
FIG. 13 is a top view of a neck pouch that is sized, shaped and articulated to contain a waist wraparound and to fit over a head of the person to rest on shoulders in a stowage mode of the waist wraparound.
Figure 14:
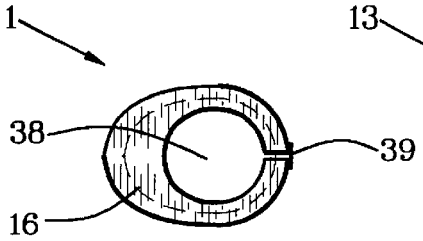
FIG. 14 is a top view of a neck pouch that is sized, shaped and articulated to contain a waist wraparound, but to be fastened for being placed around the person's neck to rest on shoulders in a stowage mode of the waist wraparound.
Figure 15:
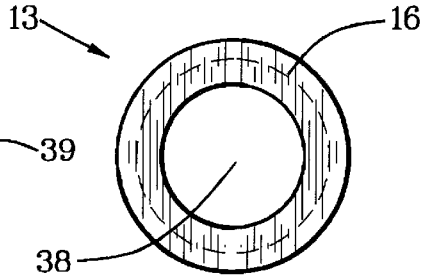
FIG. 15 is a top view of a neck pouch that is sized, shaped and articulated to contain the full-length wraparound and to fit over a head of the person to rest on shoulders in a stowage mode of the full-length wraparound.
Figure 16:
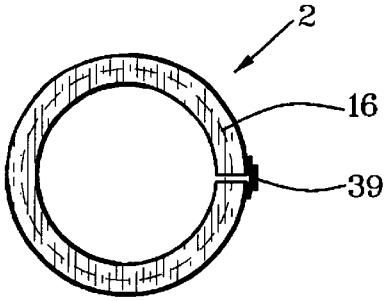
FIG. 16 is a top view of a hip pouch that is sized, shaped and articulated to contain the trouser or skirt hip wraparound.

As illustrated by comparative sizes in FIGS. 13–14, the top pouch 2 can have a closure orifice 38 shown in FIG. 6 with an inside perimeter large enough to slip over the person's head or small enough require fastening with a pouch fastener 39 that is shown in FIGS. 6 and 16 for the bottom pouch 2 also. The full-length top pouch 13 shown in FIG. 13 is preferably but need not be large enough to be slipped over the person's head to avoid need for a front fastener 40 that is optional for the full-length wraparound 12.

Figure 18:
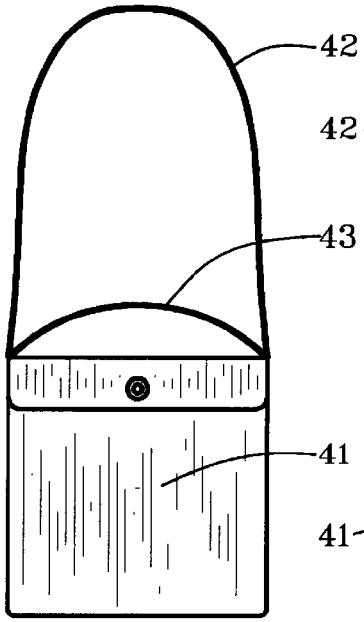
FIG. 18 is a front view of a pouch-tote bag that is sized, shaped and articulated to contain a complete foul-weather clothing system for storage and optionally for hand carrying when not wrapped around the pouch-wrap portion of the person.
Figure 19:
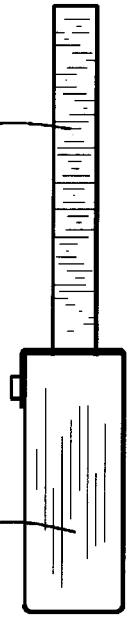
FIG. 19 is a side view of the FIG. 18 illustration.

Referring to FIGS. 18–19, a pouch-tote bag 41 is sized, shaped and articulated to contain the wraparound clothing compacted in the wraparound pouch for storage and for hand-carrying with a shoulder strap 42 or with a hand strap 43 optionally.

A new and useful foul-weather clothing system having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A foul-weather clothing system comprising:

at least one wraparound pouch for being wrapped around a predetermined pouch-wrap portion of a person;

an upper body garment for foul weather compacted in the wraparound pouch;

at least one fastener on the wraparound pouch;

the fastener being articulated and positioned to prevent release of the upper body garment from the wraparound pouch for a stowage mode and to release the upper body garment integrally attached from the wraparound pouch for a use mode; and the upper body garment being articulated to wrap around a predetermined portion of the person when the upper body garment is released from the wraparound pouch.

2. The foul-weather clothing system of claim 1 wherein:

the portion of the person around which the upper body garment defined as a wraparound clothing is articulated to wrap when released from the wraparound pouch includes the person's waist from proximate the person's neck to proximate the person's hips.

3. The foul-weather clothing system of claim 2 wherein:

the portion of the person around which the wraparound clothing is articulated to wrap when released from the wraparound pouch includes the person's right arms and left arms from proximate the person's shoulders to proximate the person's respective hands.

4. The foul-weather clothing system of claim 3 and further comprising:

right-arm fasteners to wraparound-fasten the wraparound clothing to the person's right arm;

left-arm fasteners to wraparound-fasten the wraparound clothing to the person's left arm; and waist fasteners to wraparound-fasten the wraparound clothing to the person's waist.

5. The foul-weather clothing system of claim 1 wherein:

the pouch-wrap portion of the person around which the wraparound pouch is wrapped includes the hips of the person.

6. The foul-weather clothing system of claim 1 wherein:

the upper body garment includes a waist wraparound, a right-arm wraparound and a left-arm wraparound.

7. The foul-weather clothing system of claim 6 wherein the waist wraparound is a pullover wraparound and further comprising:

a right armpit section intermediate the right-arm wraparound and the waist wraparound; and a left armpit section intermediate the left-arm wraparound and the waist wraparound.

8. The foul-weather clothing system of claim 7 wherein:

the right-arm wraparound includes a right wrist band; and the left-arm wraparound includes a left wrist band.

9. The foul-weather clothing system of claim 8 wherein:

the right armpit section has a bottom which is sufficiently lower than the person's armpit to allow movement of the person's right arm and hand from inside of the waist wraparound to inside of the right wrist band; and the left armpit section has a bottom which is sufficiently lower than the person's armpit to allow movement of the person's left arm and hand from inside of the waist wraparound to inside of the left wrist band.

10. The foul-weather clothing system of claim 6 wherein:

the waist wraparound includes a right-side opening intermediate the waist wraparound and the right-arm wraparound;

the right-arm wraparound includes a right-arm opening intermediate the right-arm wraparound and the right-side opening;

the waist wraparound includes a left-side opening intermediate the waist wraparound and the left-arm wraparound; and the left-arm wraparound includes a left-arm opening intermediate the left-arm wraparound and the left-side opening.

11. The foul-weather clothing system of claim 10 wherein:

the waist wraparound includes a waist-aft section intermediate the right-side opening and the left-side opening;

the waist wraparound includes a waist-front section intermediate the right-side opening and the left-side opening;

the waist-front section includes a front-right section and a front-left section; and the waist-front section includes an opening fastener intermediate the front-right section and the front-left section.

12. The foul-weather clothing system of claim 11 wherein:

the right-side opening, the right-arm opening, the left-side opening, the left-arm opening and the front-section opening include opening fasteners with which to fasten close the right-arm wraparound the left-arm wraparound and the waist-front section.

13. The foul-weather clothing system of claim 12 wherein:

the opening fasteners include hook-and-loop fastening members.

14. The foul-weather clothing system of claim 12 wherein:

the opening fasteners include zipper fastening members.

15. The foul-weather clothing system of claim 1 wherein:

the upper body garment includes a wraparound shawl that is extended predeterminedly long down and around the person's waist.

16. The foul-weather clothing system of claim 1 wherein:

the upper body garment includes a full-length wraparound that is extended predeterminedly long down and around the person's waist, hips and legs.

17. The foul-weather clothing system of claim 16 wherein:

the full-length wraparound includes wraparound openings that are oppositely disposed for arm and hand outlets.

18. The foul-weather clothing system of claim 1 and further comprising:

a pouch-tote bag that is sized, shaped and articulated to contain the wraparound clothing compacted in the wraparound pouch for storage and for hand-carrying with a shoulder strap or a hand strap optionally.

19. A foul-weather clothing system comprising:

at least one wraparound pouch for being wrapped around a predetermined pouch-wrap portion of a person;

a lower body garment for foul weather compacted in the wraparound pouch;

at least one fastener on the wraparound pouch;

the fastener being articulated and positioned to prevent release of the lower body garment from the wraparound pouch for a stowage mode and to release the lower body garment integrally attached from the wraparound pouch for a use mode; and the lower body garment being articulated to wrap around a predetermined portion of the person when the lower body garment is released from the wraparound pouch.

20. The foul-weather clothing system of claim 19 wherein:

the lower body garment includes a waist wraparound, a right-arm wraparound and a left-arm wraparound.

21. The foul-weather clothing system of claim 20 wherein the waist wraparound is a pullover wraparound and further comprising:

a right armpit section intermediate the right-arm wraparound and the waist wraparound; and a left armpit section intermediate the left-arm wraparound and the waist wraparound.

22. The foul-weather clothing system of claim 21 wherein:

the right-arm wraparound includes a right wrist band; and the left-arm wraparound includes a left wrist band.

23. The foul-weather clothing system of claim 22 wherein:

the right armpit section has a bottom which is sufficiently lower than the person's armpit to allow movement of the person's right arm and hand from inside of the waist wraparound to inside of the right wrist band; and the left armpit section has a bottom which is sufficiently lower than the person's armpit to allow movement of the person's left arm and hand from inside of the waist wraparound to inside of the left wrist band.

24. The foul-weather clothing system of claim 20 wherein:

the waist wraparound includes a right-side opening intermediate the waist wraparound and the right-arm wraparound;

the right-arm wraparound includes a right-arm opening intermediate the right-arm wraparound and the right-side opening;

the waist wraparound includes a left-side opening intermediate the waist wraparound and the left-arm wraparound; and the left-arm wraparound includes a left-arm opening intermediate the left-arm wraparound and the left-side opening.

25. The foul-weather clothing system of claim 24 wherein:

the waist wraparound includes a waist-aft section intermediate the right-side opening and the left-side opening;

the waist wraparound includes a waist-front section intermediate the right-side opening and the left-side opening;

the waist-front section includes a front-right section and a front-left section; and the waist-front section includes an opening fastener intermediate the front-right section and the front-left section.

26. The foul-weather clothing system of claim 25 wherein:

the right-side opening, the right-arm opening, the left-side opening, the left-arm opening and the front-section opening include opening fasteners with which to fasten close the right-arm wraparound the left-arm wraparound and the waist-front section.

27. The foul-weather clothing system of claim 26 wherein:

the opening fasteners include hook-and-loop fastening members.

28. The foul-weather clothing system of claim 26 wherein:

the opening fasteners include zipper fastening members.

29. The foul-weather clothing system of claim 19 wherein:

the lower body garment includes a wraparound shawl that is extended predeterminedly long down and around the person's waist.

30. The foul-weather clothing system of claim 19 wherein:

the lower body garment includes a full-length wraparound that is extended predeterminedly long down and around the person's waist, hips and legs.

31. The foul-weather clothing system of claim 30 wherein:

the full-length wraparound includes wraparound openings that are oppositely disposed for arm and hand outlets.

32. The foul-weather clothing system of claim 19 and further comprising:

a pouch-tote bag that is sized, shaped and articulated to contain the wraparound clothing compacted in the wraparound pouch for storage and for hand-carrying with a shoulder strap or a hand strap optionally.

33. A foul-weather clothing system comprising:

at least one wraparound pouch for being wrapped around a predetermined pouch-wrap portion of a person;

wraparound clothing for foul weather compacted in the wraparound pouch;

at least one fastener on the wraparound pouch;

the fastener being articulated and positioned to prevent release of the wraparound clothing from the wraparound pouch for a stowage mode and to release the wraparound clothing integrally attached from the wraparound pouch for a use mode;

the wraparound clothing being articulated to wrap around a predetermined portion of the person when the wraparound clothing is released from the wraparound pouch, wherein the at least one wraparound pouch includes a top pouch into which wraparound clothing including an upper body garment is compacted;

the at least one wraparound pouch includes a bottem pouch into which wraparound clothing including a lower body garment is compacted.

34. The foul-weather clothing system of claim 33 wherein:

the hip-wraparound clothing includes a trouser wraparound having trouser legs with linearly open edges that are fastened with predetermined fastener members intermediate trouser-leg bottoms and a trouser crouch.

35. The foul-weather clothing system of claim 33 wherein:

the hip-wraparound clothing includes a wraparound skirt having a skirt bottom that is extended predeterminedly intermediate feet and thighs of the person in a use mode.

36. The foul-weather clothing system of claim 33 and further comprising:

a pouch-tote bag that is sized, shaped and articulated to contain the wraparound clothing compacted in the wraparound pouch for storage and for hand-carrying with a shoulder strap or a hand strap optionally.

37. A foul-weather clothing system comprising:

at least one wraparound pouch for being wrapped around a predetermined pouch-wrap portion of a person;

wraparound clothing for foul weather compacted in the wraparound pouch;

at least one fastener on the wraparound pouch;

the fastener being articulated and positioned to prevent release of the wraparound clothing from the wraparound pouch for a stowage mode and to release the wraparound clothing integrally attached from the wraparound pouch for a use mode;

the wraparound clothing being articulated to wrap around a predetermined portion of the person when the wraparound clothing is released from the wraparound pouch, wherein the at least one wraparound pouch includes a right-leg pouch wrapped around the person's right leg upwardly from the person's right foot;

the right-leg pouch contains a right-shoe cover that is articulated to be compacted into the right-leg pouch in a stowage mode and to be released integrally therefrom to cover a right shoe on the person in a use mode;

the at least one wraparound pouch includes a left-leg pouch wrapped around the person's left leg upwardly from the person's left foot; and the left-leg pouch contains a left-shoe cover that is articulated to be compacted into the left-leg pouch in a stowage mode and to be released integrally therefrom to cover a left shoe on the person in a use mode predeterminedly.

38. The foul-weather clothing system of claim 37 and further comprising:

a pouch-tote bag that is sized, shaped and articulated to contain the wraparound clothing compacted in the wraparound pouch for storage and for hand-carrying with a shoulder strap or a hand strap optionally.

* * * * *